US005264313A

United States Patent [19]

Landa et al.

[11] Patent Number: 5,264,313

[45] Date of Patent: Nov. 23, 1993

[54] CHARGE DIRECTOR COMPOSITION

[75] Inventors: Benzion Landa, Edmonton, Canada; Yaacov Almog, Rehovat, Israel

[73] Assignee: Spectrum Sciences B.V., Wassenaar, Netherlands

[21] Appl. No.: 630,339

[22] Filed: Dec. 17, 1990

Related U.S. Application Data

[63] Continuation of Ser. No. 306,155, Feb. 6, 1989, abandoned, which is a continuation-in-part of Ser. No. 61,979, Jun. 11, 1987, Pat. No. 4,842,974, which is a continuation-in-part of Ser. No. 45,168, Apr. 24, 1987, abandoned, which is a continuation-in-part of Ser. No. 679,906, Dec. 10, 1984, abandoned.

[51] Int. Cl.[5] ..... G03G 9/08; G03G 9/13

[52] U.S. Cl. ..... 430/137; 430/114; 430/115

[58] Field of Search ..... 524/145; 438/114, 115, 438/137

[56] References Cited

U.S. PATENT DOCUMENTS

| | | | |
|---|---|---|---|
| 3,542,681 | 11/1970 | Mutaffis | 252/62.1 |
| 3,900,412 | 8/1975 | Kosel | 430/115 |
| 4,243,736 | 6/1981 | Herrmann | 430/115 |
| 4,306,009 | 12/1981 | Veillette et al. | 430/115 |
| 4,521,505 | 6/1985 | Podszun et al. | 430/112 |
| 4,631,244 | 12/1986 | Mitchell | 430/137 |
| 4,762,764 | 8/1988 | Ng et al. | 430/115 |
| 4,897,332 | 1/1990 | Gibson et al. | 430/115 |
| 4,923,778 | 5/1990 | Blair et al. | 430/137 |
| 5,047,306 | 9/1991 | Almong | 430/115 |

FOREIGN PATENT DOCUMENTS

| | | |
|---|---|---|
| 0001103 | 3/1979 | European Pat. Off. . |
| 0242806 | 10/1987 | European Pat. Off. . |
| 1930783 | 1/1970 | Fed. Rep. of Germany . |
| 2015892 | 4/1970 | France . |
| 1285465 | 8/1972 | United Kingdom . |

OTHER PUBLICATIONS

International Search Report from European Patent Office, mailed Jun. 1, 1990, in PCT/US90/00155 (based on U.S. Appl. Ser. No. 07/306,155).

*Primary Examiner*—Joseph L. Schofer
*Assistant Examiner*—Jeffrey T. Smith
*Attorney, Agent, or Firm*—Kenyon & Kenyon

[57] ABSTRACT

A method for stabilizing a charge director solution, and a charge director composition made by this method, whereby a charge director is mixed with a solvent and a polar monomer species and a polymerization reaction is initiated and allowed to progress to completion.

8 Claims, 5 Drawing Sheets

CHARACTERISTIC CURVES OF CURRENT IN LECITHIN SOLUTIONS.
1-4 ARE THE NUMBERS OF SUCCESSIVE PULSES RESPECTIVELY.

CHARGE DIRECTOR COMPOSITION

This application is a continuation of application Ser. No. 07/306,155, filed Feb. 6, 1989, now abandoned, which is a continuation-in-part of application Ser. No. 07/061,979, filed Jun. 11, 1987, now issued as U.S. Pat. No. 4,842,974, which is a continuation in part of application Ser. No. 07/045,168 filed Apr. 24, 1987, now abandoned, which is a continuation in part of application Ser. No. 06/679,906, filed Dec. 10, 1984, now abandoned.

BACKGROUND OF THE INVENTION

The present invention relates to liquid developer electrostatic photocopying and more particularly to a method of stabilizing charge director solutions and a new stabilized charge director composition.

Processes for forming electrostatic images, existing as electrostatic charge patterns upon a substrate, are well known. In electrostatic printing or copying, a photoconductive imaging surface is first provided with a uniform electrostatic charge, typically by moving the imaging surface past a charge corona at a uniform velocity. The imaging surface is then exposed to an optical image of an original to be copied. This optical image selectively discharges the imaging surface in a pattern to form a latent electrostatic image. In the case of an original bearing dark print on a light background, this latent image consists of substantially undischarged "print" portions corresponding to the graphic matter on the original, admist a "background" portion that has been substantially discharged by exposure to light. The latent image is developed by exposure to oppositely charged, pigmented, toner particles, which deposit on the print portions of the latent image in a pattern corresponding to that of the original.

In liquid developer photocopiers these charged toner particles are suspended in a liquid developer comprising a carrier liquid, toner particles and charge directors. The entire latent electrostatic image is covered with a thin film of liquid developer from a liquid developer reservoir. The charged toner particles in the liquid developer migrate to the oppositely charged "print" portions of the latent image to form a pattern on the photoconductive surface. This pattern, and the corresponding toner particles, are then transferred to a sheet to produce a visible image. Any liquid developer remaining on the photoconductive surface after this process is recycled back into the liquid developer reservoir.

Charge director plays an important role in the developing process described above. The charge director is a chemical species, either molecular or ionic, which acts to control the polarity and charge on the toner particles. The charge director creates charged species causing charging of the imaging material to ensure that the toner particles will be deposited and migrate in such a way as to form the desired image on the imaging surface. Counter ions are also created to keep the liquid developer substantially electrically neutral overall. The present invention may be practiced with any number of charge directors, of which lecithin and barium petronate are examples.

One of the major problems concerning the material used as charge directors is the degradation of the charge carrying species under the application of the electric field created during the electrophoretic development process. Degradation of the charge carrying species also occurs during replenishment of developer with carrier liquid due to dilution of the charge director. Degradation of the charge carrying species destabilizes the liquid developer electrically. Since stable electrical characteristics of the liquid developer are important to achieve a high quality image, particularly when a large number of impressions are to be produced without changing the liquid developer dispersion, degradation of the charge carrying species results in poor copy quality.

It is believed that in many liquid developers the charge director molecules form inverse micelles. An example of these micelles is shown in FIG. 1. The micelles are formed by aggregation such that the polar portion of the charge director molecules point inside, and the nonpolar portion point outside to decrease the overall surface energy of the system. These micelles may solubilize ions generated by the dissociation of the charge director molecules. It is believed that the solubilization of ions by the charge director micelles is due to the formation within and around the micelles, of a microenvironment having a higher dielectric constant. The solubilization of ions by the charge director micelles results in micelles containing a charged species in their center. Some of the micelles have a positive species in the center and others have a negative species in the center. We believe that during the electrophoretic developing process these micelles rupture under the influence of the electric field created by the charged photoconductive surface. The exact mechanism of the rupturing is not known. The rupture of the micelles changes the electrical properties of the liquid developer solution by freeing the charged species in the center of the micelles which, due to their relatively strong positive and negative charges and the low dielectric constant of the carrier liquid, tend to reassociate with each other to form electrically neutral compounds. The formation of these electrically neutral compounds changes the overall electrical properties of the liquid developer. The change in electrical properties of the liquid developer changes the toner particle dispersion in the liquid developer and the number of the charge carrying species resulting in a degradation in copy quality.

We also believe that the micelles rupture when the liquid developer dispersion in a photocopier is replenished by the addition of new carrier liquid. Again, the exact mechanism is not known. The effect of this rupturing is manifested in an instability of the charge carrying species in the system. Again the overall result is a degradation in copy quality.

Accordingly, one object of the present invention is a charge director composition which will resist degradation under the influence of an electric field.

Another object of the present invention is a charge director composition which will resist degradation during the replenishment of carrier liquid in a liquid developer dispersion.

A further object of the present invention is a charge director solution which will resist destabilization.

SUMMARY OF THE INVENTION

Figure 1:
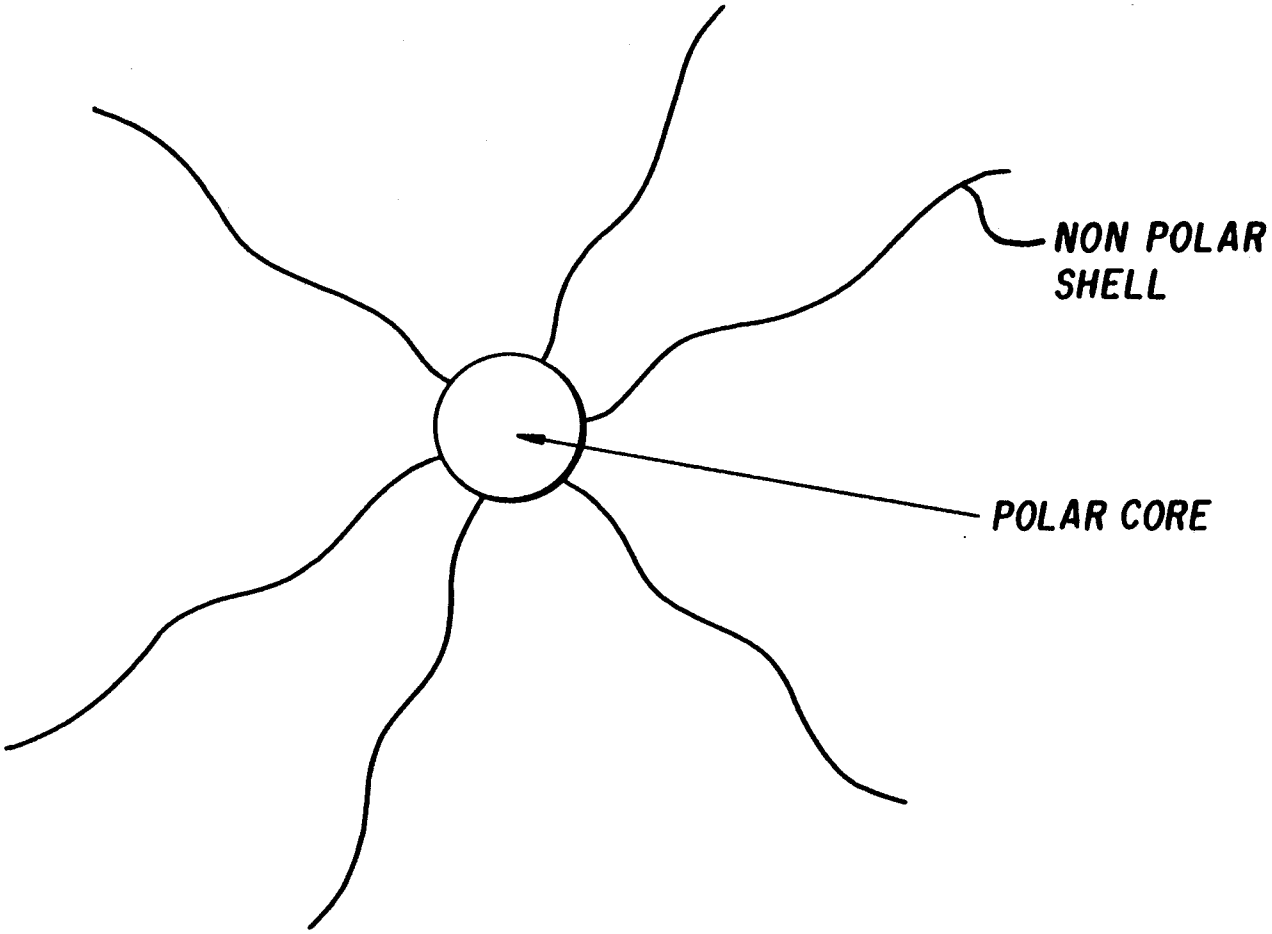
FIG. 1 is an idealized depiction of charge director micelles.

The present invention is directed to a method of stabilizing a charge director solution wherein a charge director, a solvent, and a polar monomer species are mixed, and subsequently the monomer molecules are polymerized. An initiator species is used to begin the polymerization and the reaction is allowed to proceed to substantial completion. We believe that the result is a chemical incorporation of a polar polymer species into the core of the charge director micelles. The polar species stabilizes the core of the micelles and reduces the possibility of the micelle rupturing.

In accordance with the present invention, charge director micelles are associated with insoluble polymer molecules so that the charged species are more stable and less susceptible to degradation. It will be appreciated that by reducing the degradation of the charged species of the liquid developer composition the images formed by the developer will be denser over a longer period of usage, since the presence of the charged species is essential to the electrophoretic imaging process.

DETAILED DESCRIPTION

In our invention, a charge director, a solvent, and a polar monomer species are mixed, and subsequently the monomer molecules are polymerized. An initiator species is used to begin the polymerization and the reaction is allowed to proceed to substantial completion. While the polymer species which are formed are not soluble, the monomeric species of the present invention are soluble in the solvent containing the charge director. The charge director, which is at least partially present as micelles, acts as a surfactant for the polymerization of the monomer species. It is believed the monomer species clings to the micelle and polymerizes in the core of the micelle.

The selected solvent may be any suitable solvent in which the necessary polymerization may occur. Many nonpolar solvents will work well in the present invention, including: Isopar a high purity isoparaffinic material (a trademarked product of the Exxon Corporation), Isoparafine, hexane, cyclohexane, t-butylbenzene, 2,2,4-trimethylpentane, and normal paraffins. The monomer species chosen may be any unsaturated monomer that is soluble in the selected solvent and polymerizes in the solvent in the presence of an appropriate initiator. It is believed large number of unsaturated molecules will work well in the present invention as a monomer, but certain species should work especially well, including 1-vinyl-2-pyrrolidone, 2-vinyl pyridine, vinylfuran, and methyl methacrylate.

It is believed that the initiator may be any one of a large number of species which will initiate a polymerization reaction, including azobisbutyronitrile, benzoyl peroxide, triphenylazobenzene, cumene hydroperoxide, and t-butyl peracetate.

In one preferred embodiment of the present invention Isopar is heated to approximately 50 degrees C in a reaction vessel fitted with a reflux condensor. The reaction is run under a nitrogen atmosphere. Lecithin is slowly mixed into the Isopar. The solution is heated to about 80–90 degrees C and 1-vinyl-2-pyrrolidone is added, followed by a polymerization initiator, e.g. azobisbutyronitrile. The temperature is kept constant, and the reaction is allowed to proceed for about 24 hours. The charge director composition formed by this process will be less subject to degradation of the charge-carrying species than a composition lacking the stabilizing polymer molecules. This superior resistance to degradation will be exhibited both when an electric current is applied to the composition, and when the composition is diluted with solvent (Isopar).

It is preferred to use a non-polar solvent in which the-1-vinyl-2-pyrrolidone monomer is soluble, but the polymer is insoluble. The solvent should boil at a significantly higher temperature than 90.C, so that it will remain liquid under the reaction conditions. It is believed that, as the polymerization reaction progresses, the polymer molecules will reach a critical length above which they are insoluble in the solvent; a very fine dispersion of these polymer molecules in the solvent results, and the charge director micelles form around the polymer molecules. The micelles in turn are rigidized and stabilized by the polymer molecules. The critical percent of vinyl pyrrolidone polymer needed to obtain a large stabilization effect is between about 5–9% on a weight to weight basis with respect to the charge director solids. With a polymer concentration of 9% or more, very little degradation of the charged species occurs upon dilution with solvent or the imposition of an electric field. Below a 5% polymer concentration, however, a significant amount of degradation will occur. The present invention is further illustrated by, but not limited to, the following examples.

EXAMPLE I

Under a nitrogen atmosphere, 1400 grams of Isopar-H was heated to 50 deg. C in a 4-necked, 2 liter, mechanically stirred glass reactor fitted with a reflux condensor. Isopar-H is a high purity isoparaffinic material with the following properties:

| Property | Isopar-H Properties Value | Test Method |
|---|---|---|
| SOLVENCY | | |
| Kauri-Butanol Value | 27 | ASTM D1133 |
| Analine Point | 84° C. | ASTM D611 |
| Solubility parameter | 7.2 | Calculated |
| VOLATILITY | | |
| Flash Point | 53° C. | ASTM D56 |
| Distillation | | |
| IBP | 174° C. | ASTM D86 |
| 50% | 181° C. | ASTM D86 |
| Dry Point | 189° C. | ASTM D86 |
| Vapor Pressure kPa @ 38° C. | 0.8 | ASTM D2879 |
| GENERAL | | |
| Specific Gravity @ 60/60° F. | 0.759 | ASTM D1250 |
| lb/gal. | 6.32 | Calculated |
| Color, Saybolt | +30 | ASTM D156 |
| Visosity @ 25° C. | 1.72 cST | ASTM D445 |
| Auto-Ignition Temp. | 349° C. | ASTM D2155 |
| SURFACE PROPERTIES | | |
| Surface Tension @ 25° C. | 24.9 | ASTM D971 |
| Interfacial Tension @ 25° C. | 51.4 | ASTM D971 |

600 grams of lecithin was dissolved in the Isopar-H by slow addition and stirring. The Isopar-H/Lecithin solution was then heated to 80° C. and then 102 grams of 1-vinyl-2-pyrrolidone was added to the solution. Three grams of azobisbutyronitrile suspended in 10–20 ml. of Isopar-H was then added, and the reaction allowed to proceed for 24 hours to completion.

EXAMPLE II 500 grams Isopar-H, 10 grams of lecithin, and 1.7 grams 1-vinyl-2-pyrrolidone were mixed at 90 deg. C in a 4-necked glass roundbottom flask under an $N_2$ atmosphere. 0.5 grams azobisbutyronitrile was dispersed in 20 grams of isopar and added. The reaction was allowed to proceed for 17½ hours. The resulting solution was clear, and somewhat darker than a solution of lecithin in Isopar.

The advantages of the present invention are illustrated by the following experimental results.

Figure 2:
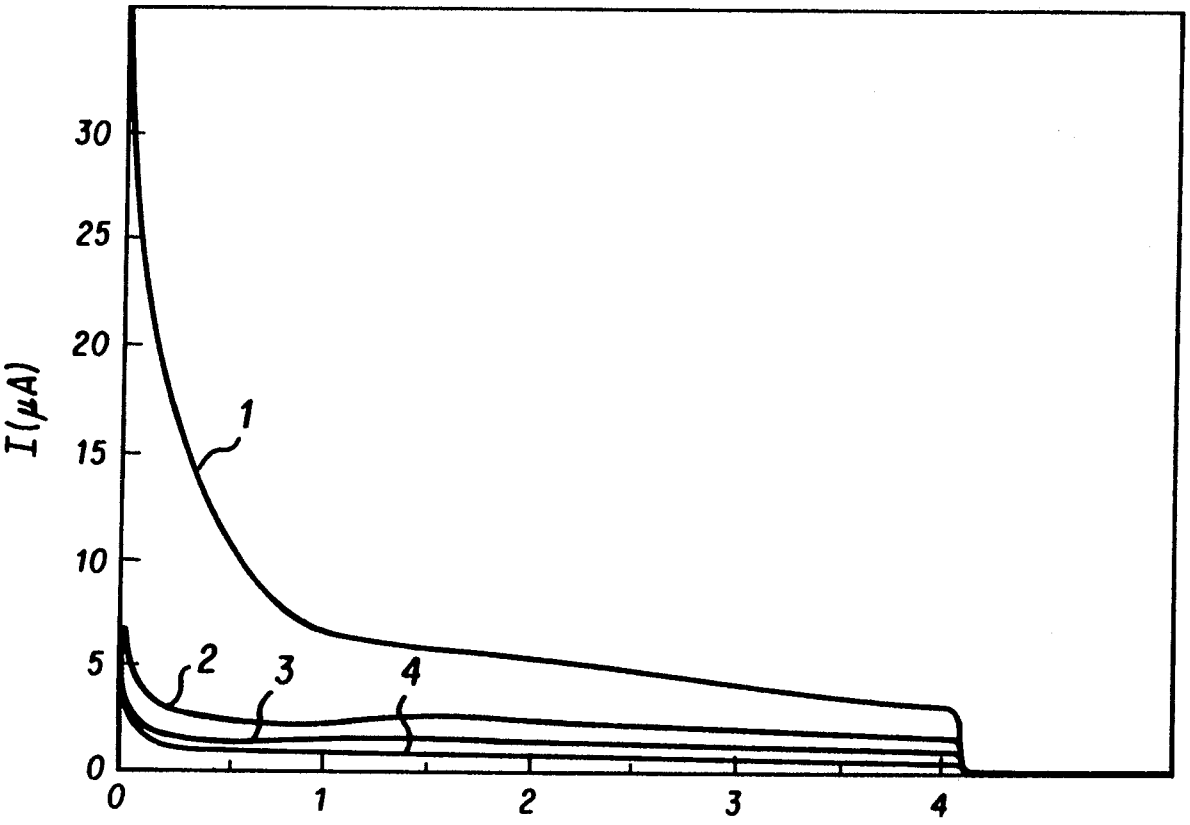
FIG. 2 is a graphic representation of the current in a lecithin solution for 4 successive electric pulses.

Table 1 and FIG. 2 show the results of our experiment on the effect of an applied electric field to a common unstabilized charge director, lecithin, solution. In the experiment 800 V. DC pulses were sequentially applied to a cell containing a lecithin solution for 4 seconds and the charge transport of the lecithin solution for each pulse was measured. Table 1 shows the charge transport in the solution for each pulse. FIG. 2 is a graphic representation of the current in the lecithin solution during the time period of the pulse.

TABLE 1

Charge Transportation in the cell versus the number of successive pulses.

| Pulse No. | Q(μC.) |
|---|---|
| 1 | 22.8 |
| 2 | 9.25 |
| 3 | 6.28 |
| 4 | 4.58 |

As shown in Table 1 and FIG. 2 the application of an electric pulse to a charge director solution changes the electrical properities of the solution. The applied electric pulse of the experiment is similar to the electric field created during the copying process. Thus the effect of the electric pulse on the lecithin solution resembles the effect of the electric field created during the copying process on the liquid developer solution.

Figure 3:
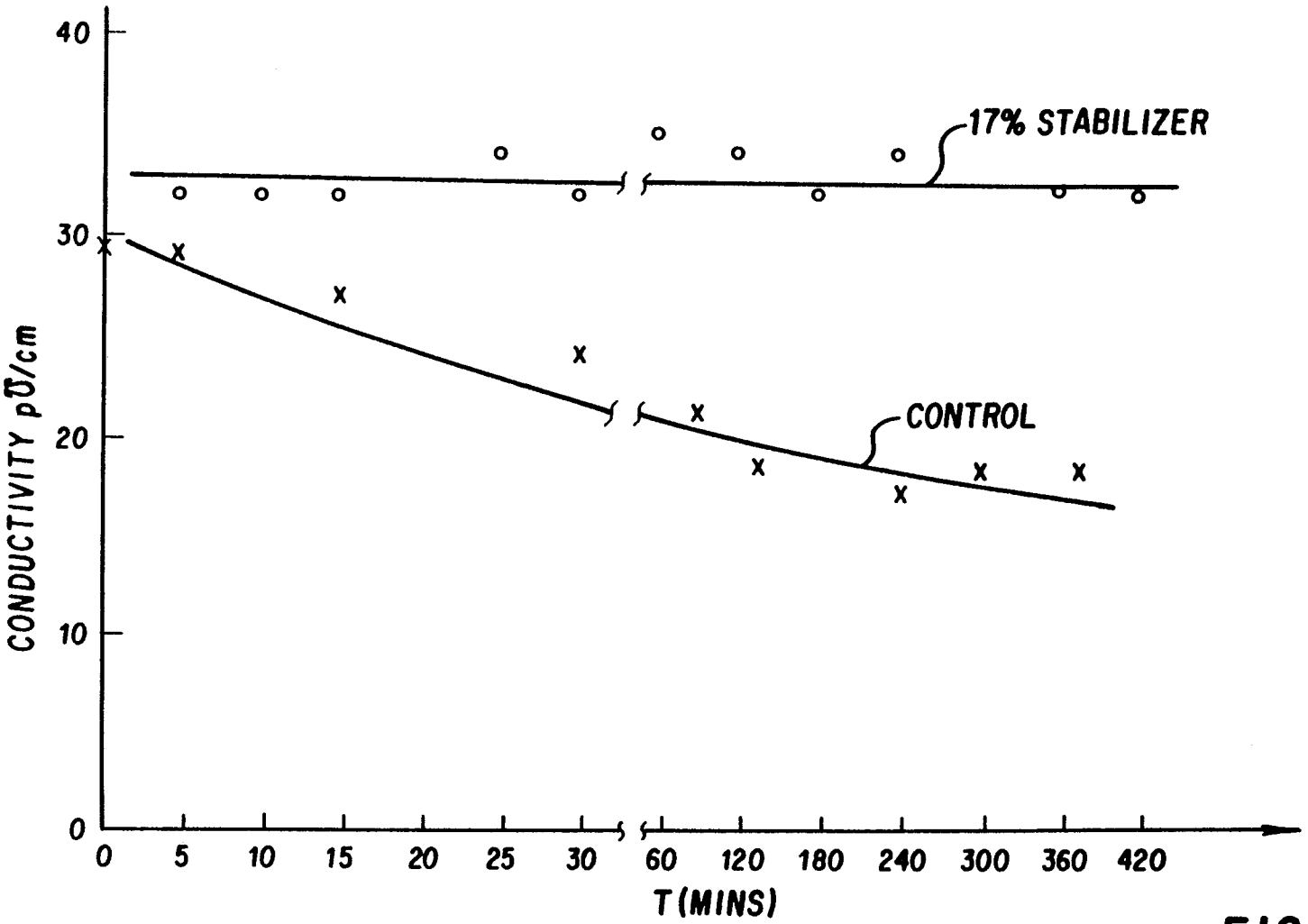
FIG. 3 is a graphic representation of the conductivity kinetics under dilution of lecithin and the material of the present invention.

FIG. 3 shows the conductivity of a composition comprising 17% monomer stabilized species by weight with respect to charge director solids, according to the present invention as compared to a lecithin control, in both cases after addition of a carrier liquid such as Isopar H. As shown in FIG. 3 the conductivity of the stabilized composition in Isopar remains relatively constant with time, while that of the control decreases with time. Thus the stabilized composition of the present invention is advantageous for use in a photocopier since the conductivity will not change appreciably with time.

Figure 4:
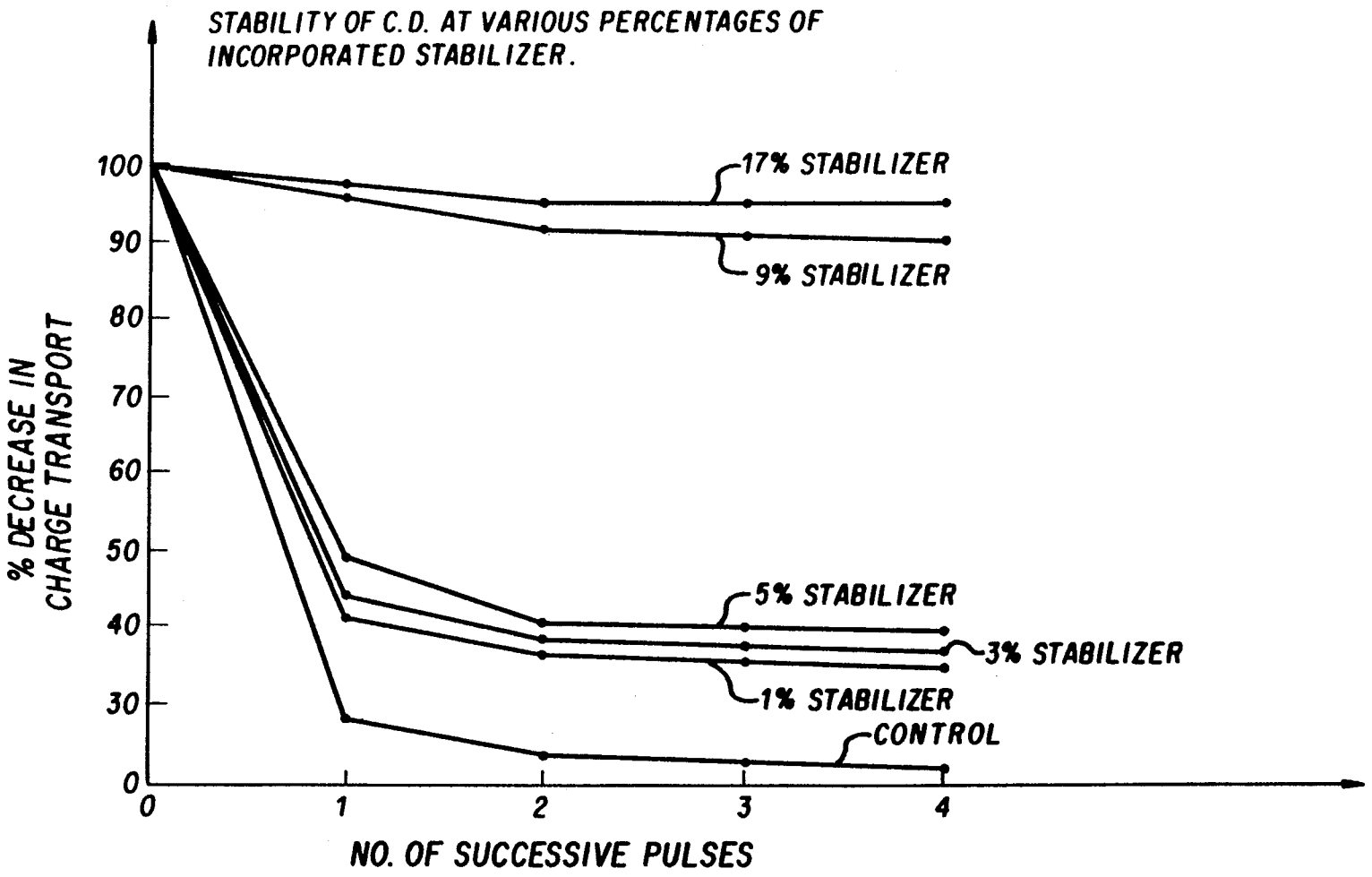
FIG. 4 is a graphic representation of the stability of various charge director compositions of the present invention.

FIG. 4 shows the results of a similar experiment on various stabilized charge director compositions according to the present invention. In this experiment 4, 800 V. DC pulses were sequentially applied to a cell containing a charge director solution and the total charge transport in the cell was measured for each pulse. The control charge director solution was an unstabilized lecithin solution as used in the above-mentioned experiment. Five stabilized charge director solutions made according to the present invention were also tested. Each charge director solution was made with a different percentage of the monomer stabilizing species. As shown in FIG. 4, the charge director should comprise between 5% and 9% by weight with respect to charge director solids or more of the monomer stabilizing species to achieve a high degree of charge transport constancy. As also shown in FIG. 4, little degradation in charge transport is maintained by a charge director composition comprising 17% monomer stabilizing species by weight with respect to charge director solids.

Figure 5:
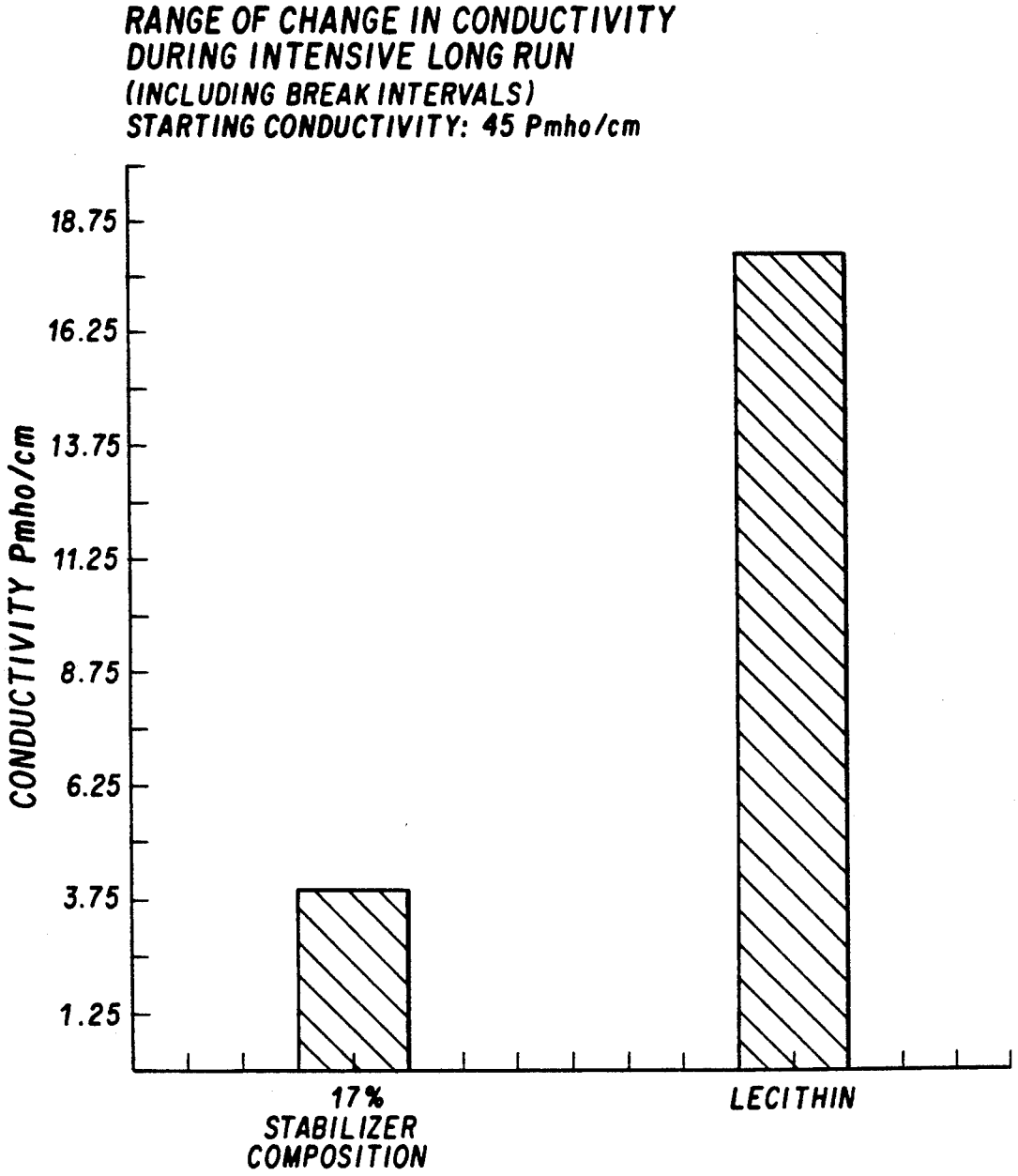
FIG. 5 shows the absolute change in conductivity during a long developing run for a 21% coverage target for lecithin and a charge director of the present invention.

FIG. 5 shows the results of an experiment on the decrease in conductivity of a charge director solution during continuous electrophotocopier operation with no paper feed. The lecithin charge director solution shown on the chart is an unstabilized ordinary charge director solution. The other charge director is made according to example 1 of the present invention comprising 17% monomer stabilizing species by weight with respect to charge director solids. As discussed in a proceeding section we believe that during the electrophotographic process unstabilized charge director micelles rupture, causing the decrease in the number of charge species, and thus a decrease in bulk conductivity of the liquid developer and a degradation in copy quality. As shown in FIG. 5 the unstabilized lecithin solution had a decrease of an 18 picomho/cm in conductivity during the electrophotocopier operation. The solution comprising 17% monomer stabilizing species by weight with respect to charge director solids, made according to example 1 of the present invention, however, showed only a 4 picomho/cm decrease in conductivity during continuous electrophotocopier operation.

It should be understood that the foregoing descriptions are for the purpose of illustration only and that the invention includes all modifications falling within the scope of the following claims.

We claim:

1. An improved charge director composition formed by a process comprising the steps of:

dissolving a charge director in a non-polar solvent and a monomer species;

initiating a polymerization reaction among molecules of said monomer species; and allowing said polymerization reaction to progress to completion to thereby associate the polymer thus formed with said charge director thereby producing said improved charge director composition.

2. A charge director composition as in claim 1 wherein the non-polar organic solvent is an isoparaffinic material having a specific gravity of 0.759@60/60° F., a Saybolt Color +30, a viscosity of 1.72 cST@25° C. and an auto-ignition temperature of 349° C.

3. A charge director composition as in claim 1 wherein the charge director is lecithin.

4. A charge director composition as in claim 1 wherein the polymer is polyvinylpyrrolidone.

5. A charge director as in claim 1 wherein the polar monomer species comprises at least 5% by weight with respect to charge director solids.

6. A charge director as in claim 1 wherein the polar monomer species comprises 5% to 9% by weight with respect to charge director solids.

7. A charge director as in claim 1 wherein the polar monomer species comprises between 10% and 17% by weight with respect to charge director solids.

8. A charge director composition as in claim 1 wherein said solvent is a nonpolar organic compound or mixture of compounds.

* * * * *

UNITED STATES PATENT AND TRADEMARK OFFICE

CERTIFICATE OF CORRECTION

PATENT NO. : 5,264,313
DATED : November 23, 1993
INVENTOR(S) : Benzion Landa, et al.

It is certified that error appears in the above-indentified patent and that said Letters Patent is hereby corrected as shown below:

Column 4, line 16, change "90.C" to read --90°C--.

Column 4, lines 54-57, Align numbers in "Isopar-H Properties Value" column.

Signed and Sealed this

Thirtieth Day of August, 1994

*Attest:*

*Attesting Officer*

BRUCE LEHMAN

*Commissioner of Patents and Trademarks*